United States Patent [19]

Freeman

[11] 4,050,119

[45] Sept. 27, 1977

[54] TEXTILE CARDING MACHINE OPERATING SYSTEM AND METHOD

[75] Inventor: Joseph L. Freeman, Greenville, S.C.

[73] Assignee: John D. Holligsworth on Wheels, Inc., Greenville, S.C.

[21] Appl. No.: 763,965

[22] Filed: Jan. 31, 1977

[51] Int. Cl.[2] ..... D01G 15/46

[52] U.S. Cl. ..... 19/106 R

[58] Field of Search ..... 19/106 R, 98, .25; 318/305, 443, 447

[56] References Cited

U.S. PATENT DOCUMENTS

| | | | |
|---|---|---|---|
| 3,300,817 | 1/1967 | Binder et al. | 19/.21 |
| 3,965,401 | 6/1976 | Jones, Jr. et al. | 19/106 R |
| 3,982,301 | 9/1976 | Llach et al. | 19/106 R X |

FOREIGN PATENT DOCUMENTS

| | | | |
|---|---|---|---|
| 1,092,364 | 11/1967 | United Kingdom | 19/106 R |

*Primary Examiner*—Dorsey Newton

*Attorney, Agent, or Firm*—Bailey, Dority & Flint

[57] ABSTRACT

A drive for a textile carding machine is illustrated wherein a direct current motor is provided for returning the doffer to operating or production speed, following a run at slow speed as for putting an end up, independently of the other driven card components which is de-energized after the doffer has attained operating speed. A drive connection provided between the licker-in and the barrow pulley thereafter drives the doffer at operating speed. The method thus contemplates driving the doffer from slow to operating speed independently of the usual driving components of the card and then when the doffer is at operating speed, utilizing the usual driving components of the card to drive the doffer after discontinuing independent driving of the doffer.

7 Claims, 4 Drawing Figures

TEXTILE CARDING MACHINE OPERATING SYSTEM AND METHOD

BACKGROUND OF THE INVENTION

Many attempts have been made to develop a satisfactory operating system for temporarily bringing the doffer and associated feed mechanism to slow or creep speed to permit adjustments or repairs to be made such as the putting up of an end of sliver. While it is not necessary with standard cards, which operate at slower speed, to reduce the doffer and associated feed mechanism to slow or creep as for such purposes, with high speed carding it is necessary to reduce the output of the card to provide sufficient time to re-establish the web and to place the sliver in the coiler head. An attempt has been made to use an alternating current motor drive for the doffer which is independent of the main cylinder as well as other driving components of the card. Due to the characteristics of an alternating current motor, however, the acceleration from slow speed to operating speed occurs too quickly causing a jerking action resulting in unevenness and thin places in the web. An attempt to utilize a direct current motor operated independently of the main cylinder for driving the doffer at all times has met with limited success. Due to the characteristics of the direct current motor, it is difficult to maintain the required degree of uniformity of speed in order to be compatible with the other driven components of the card. Therefore, it is necessary to monitor electronically the speed of the direct current motor at all times. Furthermore, direct current motors tend to have a short useful life when put to such use making frequent and expensive replacement necessary.

Accordingly, it is an important object of this invention to provide a card drive facilitating the operation of the doffer and associated feed mechanism at slow or creep speed for permitting necessary alterations to the card and for returning the doffer and associated feed mechanism to operating speed without producing excessive undesirable web variations.

Another important object of the invention is the facilitating of carding operations wherein the doffer is run at reduced speed in order to permit repairs to be made in such a way that the doffer may be returned with controlled uniform acceleration to operating speed after which the other card driving mechanisms may be utilized for driving the doffer at operating speeds.

Still another important object of the invention is the provision of a control mechanism permitting the utilization of a direct current motor for independently operating the doffer and associated mechanism at low speed, returning the doffer to run speed and then discontinuing the operation of the direct current motor permitting utilization of the regular card drive for operation of the doffer at operating speeds.

BRIEF DESCRIPTION OF THE INVENTION

It has been found that by utilizing suitable controls and drives a direct current motor may be utilized for independently operating the doffer and associated feed mechanism when operating at slow or creep speed and for returning the doffer and associated feed mechanism to operating speed and that such independently operated direct current motor may be discontinued thereafter and a driving connection utilized with normally driven card components, such as from the licker-in. The method contemplates independently controlling the speed of the doffer during operations at slow speed and the return thereof to operating speeds with discontinuance of the independent drive and utilizing the normally driven card components for operating speeds. Thus, the problem of running a high speed card at creep speed for making repairs and returning the card to running speed has been solved in a practical way for acceptable mill operation. A new result has been achieved through the new function of controls, drive and direct current motor.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate an operating system for a textile card having a doffer gear for driving a doffer, a barrow pulley for driving the doffer gear and a driven licker-in. Drive means A are engagable between the licker-in and the doffer gear for driving the doffer at operating speed. Means is provided in the form of an electric clutch B for disengaging the drive means A for low speed operation of the doffer and associated feed mechanism. A direct current motor C is provided for independently driving the doffer gear when the drive means A is thus disengaged. Clutch means D disengages the direct current motor C from the doffer gear when the doffer has been returned to operating speed as after repairs have been made. Control means are provided for actuating the clutch B and deenergizing the direct current motor C engaging the drive means A for normal operation at run speed when the direct current motor C has returned the doffer to operating speed.

Figure 1:
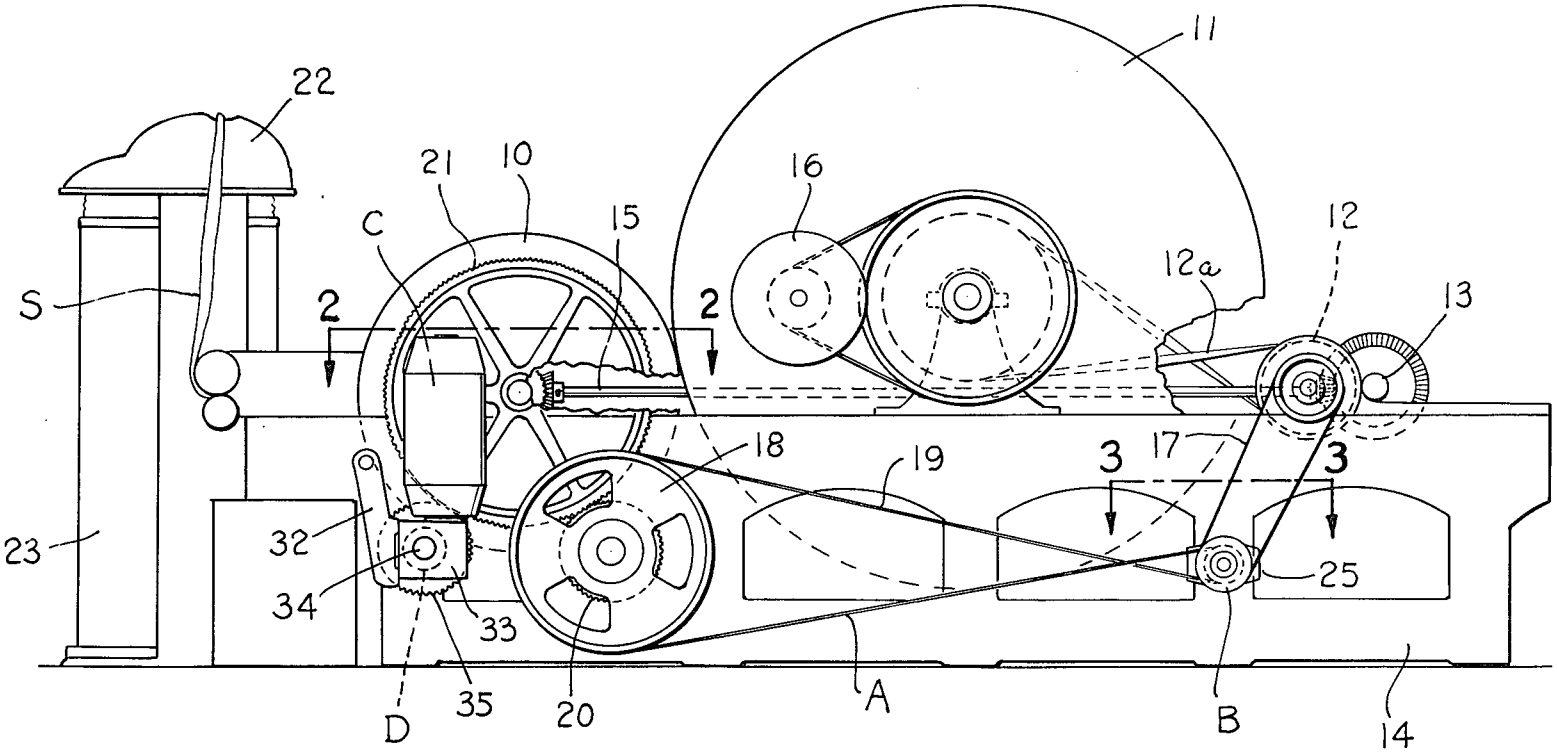
FIG. 1 is a schematic side elevation illustrating a card with an operating system constructed in accordance with the present invention.

Referring more particularly to FIG. 1, the doffer 10, main cylinder 11, licker-in 12 and feed roll 13 are carried for rotation between transversely spaced frame members 14. The feed roll 13 is illustrated as being driven from the doffer as by the conventional drive 15. The main cylinder 11 is illustrated as being driven by the motor 16 which serves as the drive for the operating components of the card during operation at normal operating or run speed. A standard drive **12*a* is provided for driving the licker-in 12 from the main cylinder. During normal operating conditions the licker-in, through suitable drive means 17, drives a barrow pulley 18 through a belt drive 19. The barrow pulley 18 carries a fixed gear 20 for driving the usual doffer gear 21 which has fixed driving connection to the doffer 10**.

It will be observed that the sliver S passes from the web handling apparatus of the card to the coiler head 22 from whence it is distributed into the usual sliver can 23.

Figure 3:
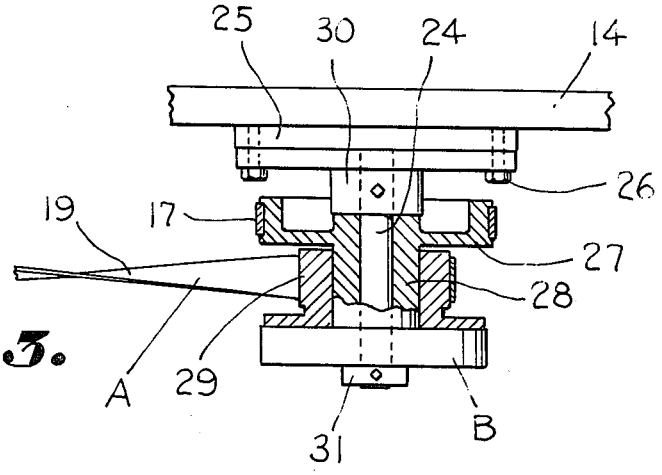
FIG. 3 is a top plan view taken on the line 3—3 in FIG. 1 illustrating a clutch mechanism associated with the licker-in drive.
Figure 2:
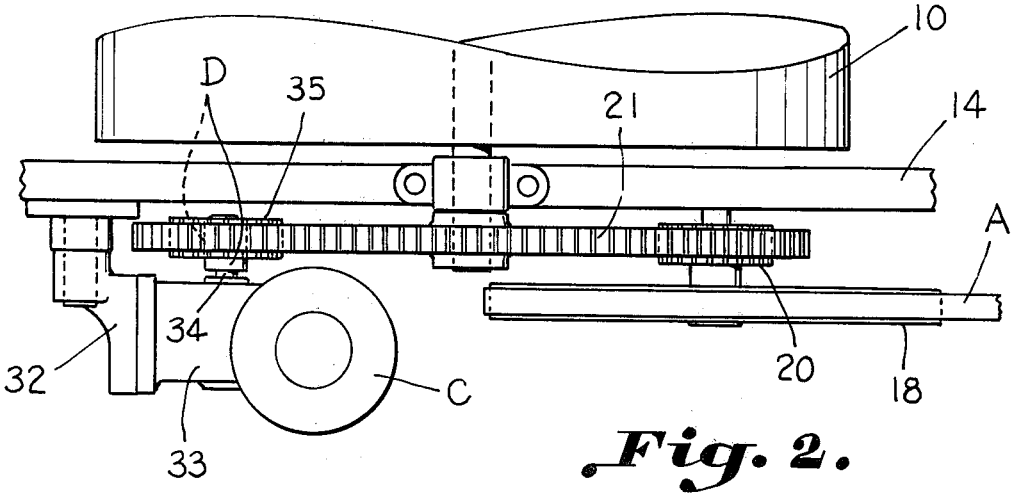
FIG. 2 is a top plan view taken substantially along the line 2—2 in FIG. 1 illustrating the direct current motor and driving connections therefor.

The drive means A includes the belt 19 which provides driving connection between the barrow pulley 18 and a power take off mechanism driven by the licker-in 12. The power take off mechanism includes a fixed shaft 24 carried by a suitable bracket means 25 secured as by bolts 26 to the card frame member 14 (FIG. 3). A sheave 27 is driven by the belt 17 from the licker-in and turns freely on the shaft 24. The sheave 27 carries a spindle 28 which carries a pulley 29 thereon which drives the belt 19. The pulley 29 is connected during normal operation at run speed by the electric clutch B, the engagement of which provides a driving connection between the licker-in 12 and the belt 19. It will be observed that spaced collars 30 and 31 are provided for positioning the aforementioned elements upon the shaft 24 therebetween.

The direct current motor C has a suitable mouting 32 for affixing a gear reducer 33 for supporting the motor carried upon the side frame member 14. The gear reducer 33 has a power take off shaft 34 which carries clutch means D in the form of an over-running clutch positioned within the gear 35 so as to overrun when the doffer is faster than the motor drive. The gear 35 is in driving relationship meshed with the doffer gear 21.

Figure 4:
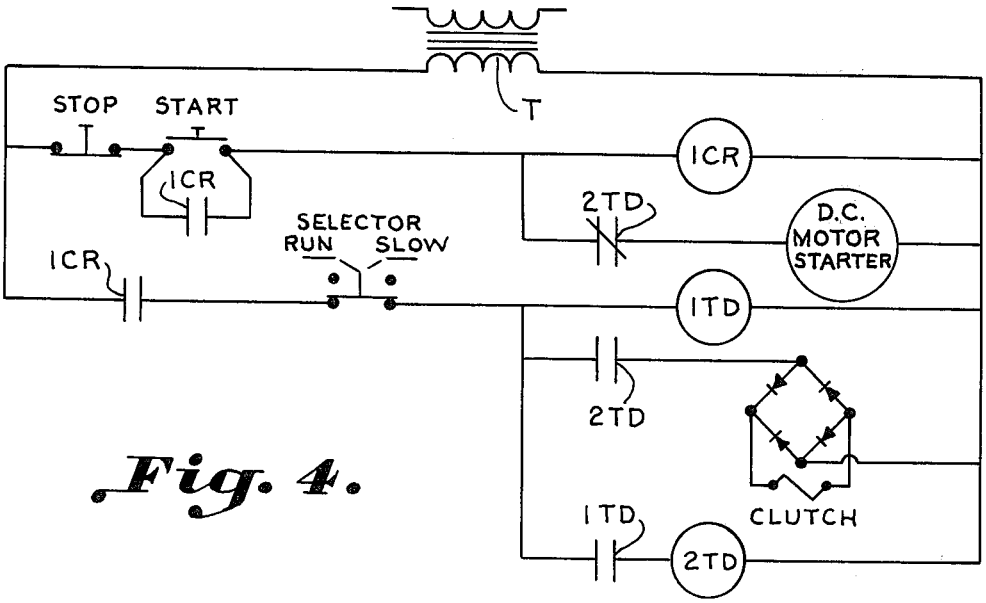
FIG. 4 is a schematic diagram illustrating various electrical components of the control circuitry for operating the drive constructed in accordance with the present invention.

The transformer T (FIG. 4) energizes the control circuit supplying, in this embodiment, 24 volts on the secondary. For start up, with the main cylinder turning and the selector in the run position as shown, the operator presses the start button actuating 1CR relay closing 1CR contact. This also closes the circuit to the direct current motor starter which puts the direct current motor in the slow mode. Also, 1 TD relay starts a sixty second timing cycle, after which 1TD contact closes actuating 2TD relay, which permits a timed acceleration of the direct current motor, slow to run or high speed. At the end of this timing cycle of 1TD relay, normally closed 2TD contact opens the circuit to the direct current motor starter and closes the normally open 2TD contact which actuates the clutch B.

The doffer is now driven from the licker-in through the drive means A. When the operator places the selector switch in slow position, again putting the direct current motor in slow mode for putting an end up or other adjustment, a similar procedure is thereafter followed for returning the doffer and associated feed mechanism to run speed. When the doffer gear is turning slower than the power take off from the direct current motor, the doffer is being driven by the direct current motor. Also, since the torque at high speed is less at the licker-in it is possible to use a smaller clutch than would be required if the clutch were associated with the barrow pulley.

While a preferred embodiment of the invention has been described using specific terms, such description is for illustrative purposes only, and it is to be understood that changes and variations may be made without departing from the spirit or scope of the following claims.

What is claimed is:

1. An operating system for a textile card having a doffer gear for driving a doffer gear and a driven licker-in comprising:

drive means between said licker-in and said doffer gear for driving the doffer from the licker-in at operating speed;

means for engaging and disengaging the drive means;

a direct current motor for driving said doffer gear when said drive means is disengaged;

means for engaging and disengaging said direct current motor with said doffer gear; and control means for engaging said drive means and de-energizing the direct current motor when said direct current motor has returned the doffer to operating speed.

2. The structure set forth in claim 1, wherein said drive means includes a pulley driven by said licker-in, and wherein said means for engaging and disengaging the drive means includes a clutch connected to said pulley.

3. An operating system for a textile card having a drive including means for driving a doffer at operating speed comprising:

means disengaging said means for driving the doffer at operating speed;

a direct current motor for driving the doffer at slow speed and thereafter returning the doffer to operating speed when said means for driving the doffer is disengaged; and means for re-engaging said means for driving the doffer at operating speed and for de-energizing said direct current motor when said direct current motor has returned the doffer to operating speed.

4. An operating system for a textile card having a doffer and a driven licker-in comprising:

a belt drive affording a driving connection between said licker-in and said doffer for driving said doffer at operating speed;

said belt drive including a pulley driven from said licker-in;

an electric clutch for engaging and disengaging said pulley;

a barrow pulley driven from said first mentioned pulley when said clutch is engaged;

a doffer gear driven by said barrow pulley;

a direct current motor carried adjacent said barrow pulley; and an over-running clutch for engaging said direct current motor in driving engagement with said doffer gear when said doffer gear is turning at a slower speed than said direct current motor.

5. The structure set forth in claim 4 including control means for actuating said direct current motor causing a uniform acceleration of said doffer from slow to high speed and for thereafter de-energizing said direct current motor.

6. The structure set forth in claim including a fixed shaft carried adjacent said licker-in, and a shive driven by said licker-in on which said first mentioned pulley is rotatably carried.

7. The method of operating a textile card having operating components including a doffer and a licker-in driven at operating speed comprising:

driving the doffer independently of the other oeprating components of the card at slow speed;

continuing driving the doffer independently of the other operating components of the card while increasing the speed of the doffer to operating speed; and driving the doffer at operating speed from the licker-in when the speed of the doffer is increased to operating speed; and discontinuing said independent driving of the doffer.

* * * * *